US012017128B1

(12) United States Patent
Reynolds

(10) Patent No.: US 12,017,128 B1
(45) Date of Patent: Jun. 25, 2024

(54) EXERCISE BENCH WITH INTEGRATED WEIGHT STORAGE UNIT

(71) Applicant: Cap Barbell, Inc., Houston, TX (US)

(72) Inventor: Curt Reynolds, Houston, TX (US)

(73) Assignee: CAP BARBELL, INC., Houston, TX (US)

( * ) Notice: Subject to any disclaimer, the term of this patent is extended or adjusted under 35 U.S.C. 154(b) by 0 days.

(21) Appl. No.: 18/061,240

(22) Filed: Dec. 2, 2022

(51) Int. Cl.
*A63B 71/00* (2006.01)
*A63B 21/00* (2006.01)
*A63B 21/072* (2006.01)

(52) U.S. Cl.
CPC ..... *A63B 71/0036* (2013.01); *A63B 21/0726* (2013.01); *A63B 21/4029* (2015.10)

(58) Field of Classification Search
CPC ..... A63B 71/0036; A63B 21/0726; A63B 21/4029; A63B 60/56; A63B 21/078; A63B 21/4027; A47F 5/0876
See application file for complete search history.

(56) References Cited

U.S. PATENT DOCUMENTS 5,626,244 A * 5/1997 Mesna ..... E04H 17/066 211/85.7
5,924,964 A * 7/1999 Hayden ..... A63B 21/4029 482/142
6,030,324 A * 2/2000 McBride ..... A63B 21/4029 482/142
D933,143 S * 10/2021 Saragoni ..... D21/690
2019/0151699 A1* 5/2019 Isom ..... A63B 21/00061
2019/0240528 A1* 8/2019 Donnelly ..... A63B 21/4029
2022/0233910 A1* 7/2022 Leavitt ..... A63B 21/4035

OTHER PUBLICATIONS

"Double Circle Dumbbells Rack Home Gym Storage (Rack Only), 6-Slot Free Weight Holder, Heavy-Duty Wall-Mounted Steel Stand for Strength Training Equipment, 2 Carabiners and Mounting Hardware" (https://www.amazon.com/Double-Circle-Organizer-Multi-Purpose-Exercise/dp/B08XQT4HJD) Mar. 1, 2021 (Year: 2021).*
Home Fit Freak, "In Depth Review of the Rogue Bolt Together Flat Utility Bench", https://thehomefitfreak.com/rogue-bt-flat-utility-bench-review/, accessed Jul. 11, 2023, posted May 12, 2020 (Year: 2020).*

* cited by examiner

*Primary Examiner* — Megan Anderson
*Assistant Examiner* — Sara K. Conway
(74) *Attorney, Agent, or Firm* — D'Ambrosio & Menon, PLLC; Usha Menon

(57) ABSTRACT

A multifunctional and compact exercise apparatus includes an exercise bench with an integrated weight storage unit. The weight storage unit can be configured to store one or more weights in a vertical orientation. The weight storage unit can include a bracket member. The bracket member can include a mounting sidewall and a storage sidewall. The storage sidewall can extend outward substantially or generally perpendicularly from the mounting sidewall. The storage sidewall can include a planar plate-like member having a plurality of cut-outs or slots formed therein. Each slot can be dimensioned to receive a weight in a vertical orientation.

8 Claims, 12 Drawing Sheets

EXERCISE BENCH WITH INTEGRATED WEIGHT STORAGE UNIT

FIELD OF THE INVENTION

The present invention relates generally to exercise equipment. In particular, it pertains to an exercise bench with an integrated weight storage unit.

BACKGROUND

The background description includes information that may be useful in understanding the present invention. It is not an admission that any of the information provided herein is prior art or relevant to the presently claimed invention, or that any publication specifically or implicitly referenced is prior art.

An exercise bench is an accessory that can be used by those engaged in strength training. The exercises involve strengthening and toning both the upper body and lower body using weights. The exercise bench facilitates proper posture when doing these exercises. The exercise bench can allow the user to sit up or lie down in the right position so that they can perform a workout correctly and, as such, is a very helpful piece of exercise equipment.

Weights, such as, dumbbells, are stored in weight storage units or weight stands. These weight stands are freestanding or standalone units that are configured to organize and store multiple dumbbells, in a safe and proper orientation, when not in use.

Currently, exercise benches and weight stands are sold as separate units. A standalone weight stand consumes space, which is usually at a premium in most gyms or homes. While weights can be placed on the floor beneath the exercise bench, that is not optimal from a safety or a usage standpoint. Therefore, there is a need for an improved exercise bench that obviates the requirement for a separate weight stand.

SUMMARY

An improved exercise apparatus is provided to solve the above-described limitations of conventional dumbbell storage presently known in the art. According to an embodiment, an exercise apparatus includes an exercise bench with an integrated or mountable weight storage unit. The weight storage unit can be coupled to a sidewall of the bench frame. The weight storage unit can be configured to store a plurality of weights in a vertical orientation.

In one or more embodiments, the weight storage unit can include at least one bracket member. The bracket member can include a mounting sidewall and a storage sidewall. The mounting sidewall can be coupled to a first sidewall of the bench frame. The storage sidewall can extend outward substantially or generally perpendicularly from the mounting sidewall. The storage sidewall can include a planar plate-like member having a plurality of cut-outs or slots formed therein. Each slot can be dimensioned to receive a weight in a vertical orientation.

In one or more embodiments, the weight is a dumbbell. Dumbbells, typically, include a handle portion, a first weight head and a second weight head. According to an embodiment, at least a portion of the dumbbell handle is configured to be securely received within a slot in the storage sidewall. A basal portion of a first weight head can be configured to be held above the slot. At least a portion of the first weight head can abut a first surface portion of the plate-like member. However, it is understood that the one or more embodiments can also be used to store dumbbells that are molded as one piece, instead of two heads attached to a handle.

Various objects, features, aspects, and advantages of the inventive subject matter will become more apparent from the following detailed description of preferred embodiments and the accompanying drawing figures in which like numerals represent like components.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples or exemplary language (for example, "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various terms are used herein. To the extent a term used in a claim is not defined, it should be given the broadest definition persons in the pertinent art have given that term as reflected in printed publications and issued patents at the time of filing.

Figure 1A:
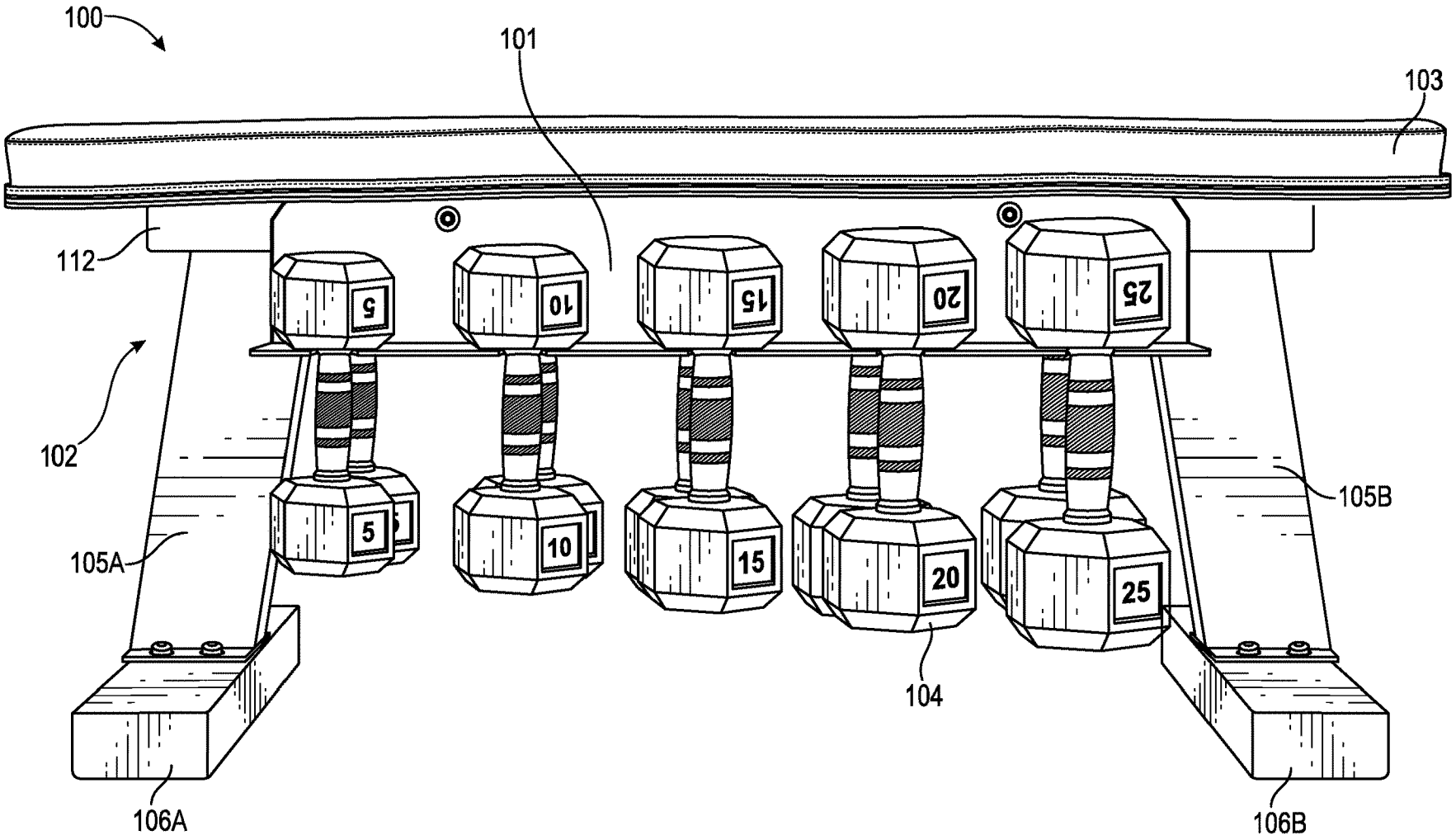
FIGS. 1A-3 illustrate exemplary views of an exercise apparatus, according to an embodiment.
Figure 1B:
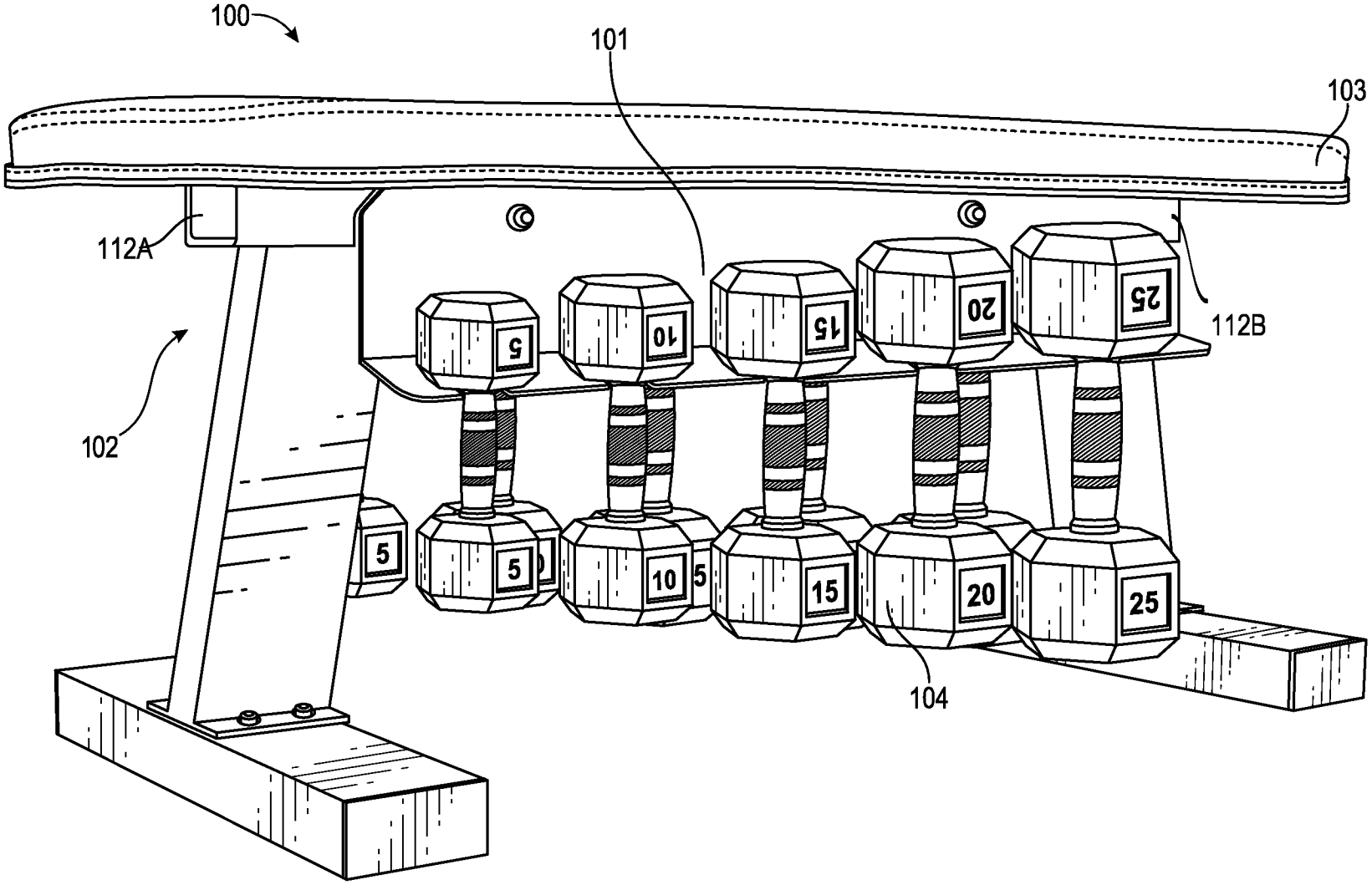

FIGS. 1A and 1B illustrate exemplary views of an exercise apparatus 100 in accordance with one or more embodiments. The exercise apparatus 100 includes an exercise bench 102 and an integrated/built-in weight storage unit 101. As used herein, the term "exercise bench" encompasses weight benches, fitness benches, strength training benches and utility benches that are configured to be inclined or declined. The weight storage unit 101 is specially configured to store a plurality of weights or dumbbells (the terms "weights" and "dumbbells" are used interchangeably herein) 104 in a vertical orientation. However, it is understood that other weights, such as, kettlebells and barbells are within the scope of the invention. The vertical orientation allows for better access and organization of the weights.

Exercise bench 102 can include a heavy duty, elongate, bench frame 112 made of a suitable material. The bench frame 112 can include a top and bottom sidewall/surface, left and right surfaces/sidewalls, and front and back surfaces/sidewalls. A cushion or pad 103 can be secured to a top surface of the bench frame. The exercise bench 102 can further include a pair of leg members 105A and 105B. A first end of a first leg member 105A is affixed or welded to a bottom surface of a first end of the bench frame 112A, while a first end of a second leg member 105B is affixed or welded to a bottom surface of a second end of the bench frame 112B. A second end of the leg members 105A and 105B is affixed or welded to an upper surface of corresponding feet members 106A and 106B respectively. The leg members 105A and 105B can be angled outward from opposing ends of the bench frame 112 while the feet members 106A and 106B are oriented substantially perpendicular to a plane of the bench frame 112. The leg members 105A and 105B and feet members 106A and 106B can be configured to support the bench frame 112 and provide stability to the exercise bench. It is understood that the bench frame, leg members and feet members can have other configurations without deviating from the scope of the present invention. For instance, the bench frame, the leg members, and feet members may be molded as a single unit. Various embodiments of the bench frame 112 are discussed herein with reference to FIGS. 4A-7B.

In one embodiment, the weight storage unit 101 can be integrally mounted such that it extends substantially the length of the bench frame, that is from a first end of the bench frame 112A to a second end of the bench frame 112B to maximize storage. However, in one or more other embodiments, the weight storage unit 101 can be configured to extend only a portion of the length of the bench frame 112. For example, the weight storage unit 101 can be configured to extend between 10%-90% of the length of the bench frame 112.

The exercise apparatus 100 is a multifunctional equipment with space-saving characteristics. It allows for compact storage and ease of use of the weights 104 while the user (not shown) is sitting or lying down on the bench 102. For instance, a user may perform full body exercises or seated exercises, such as, bicep and triceps curls while having convenient access to the weights 104 organized in the weight storage unit 101 positioned beneath the bench 102. Moreover, the user may switch weights 104 as they see fit without moving from a seated position, for example, on the exercise bench 102.

Since the weight storage unit 101 is mounted on the exercise bench 102, it eliminates the need for the user to purchase a separate or standalone weight storage unit. In addition to cost savings, the integration of the weight storage unit 101 with the exercise bench ensures that the user does not have to find space for both an exercise bench and a standalone weight storage unit, which can be beneficial especially in space-constrained environments.

Figure 2:
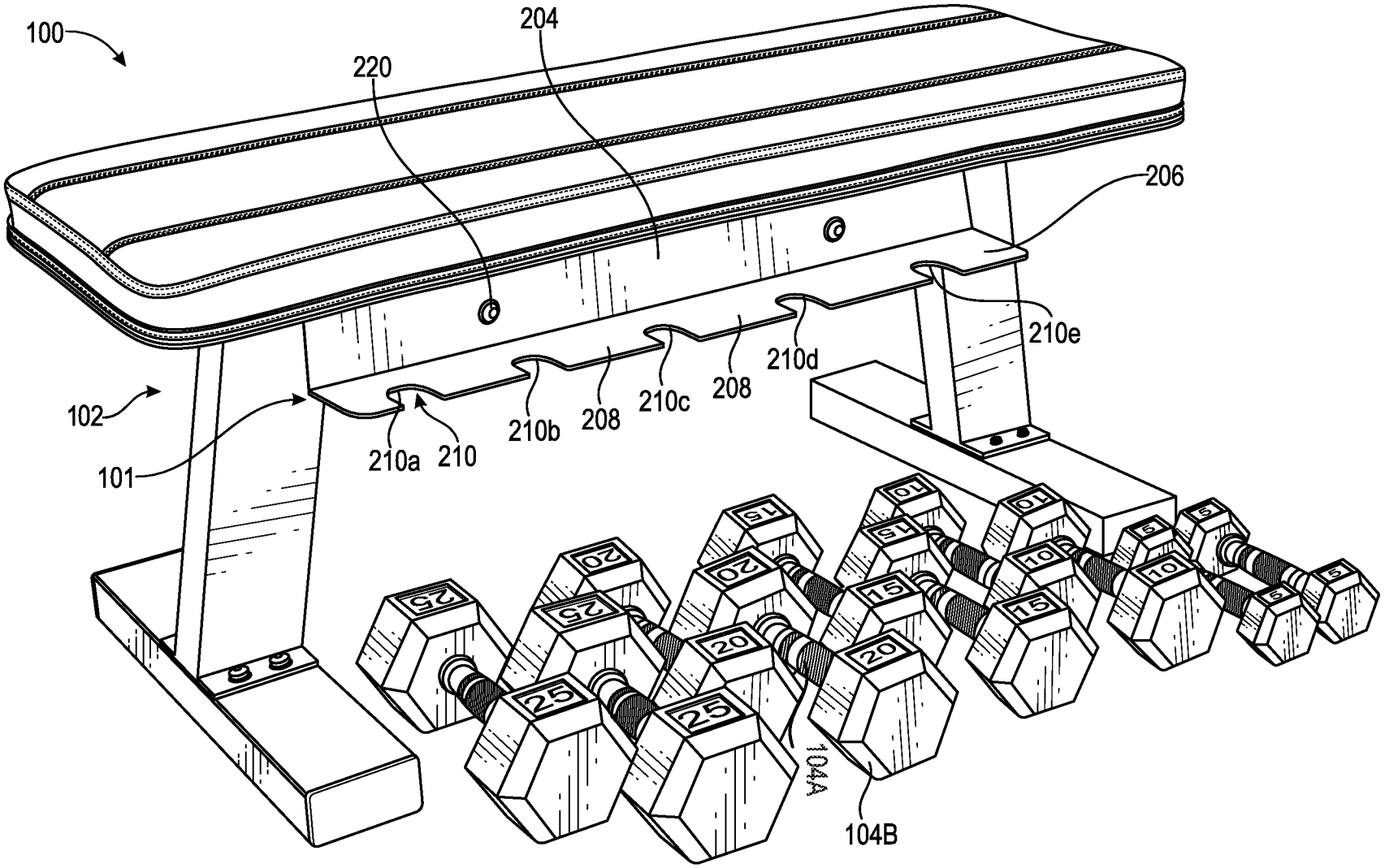
Figure 3:
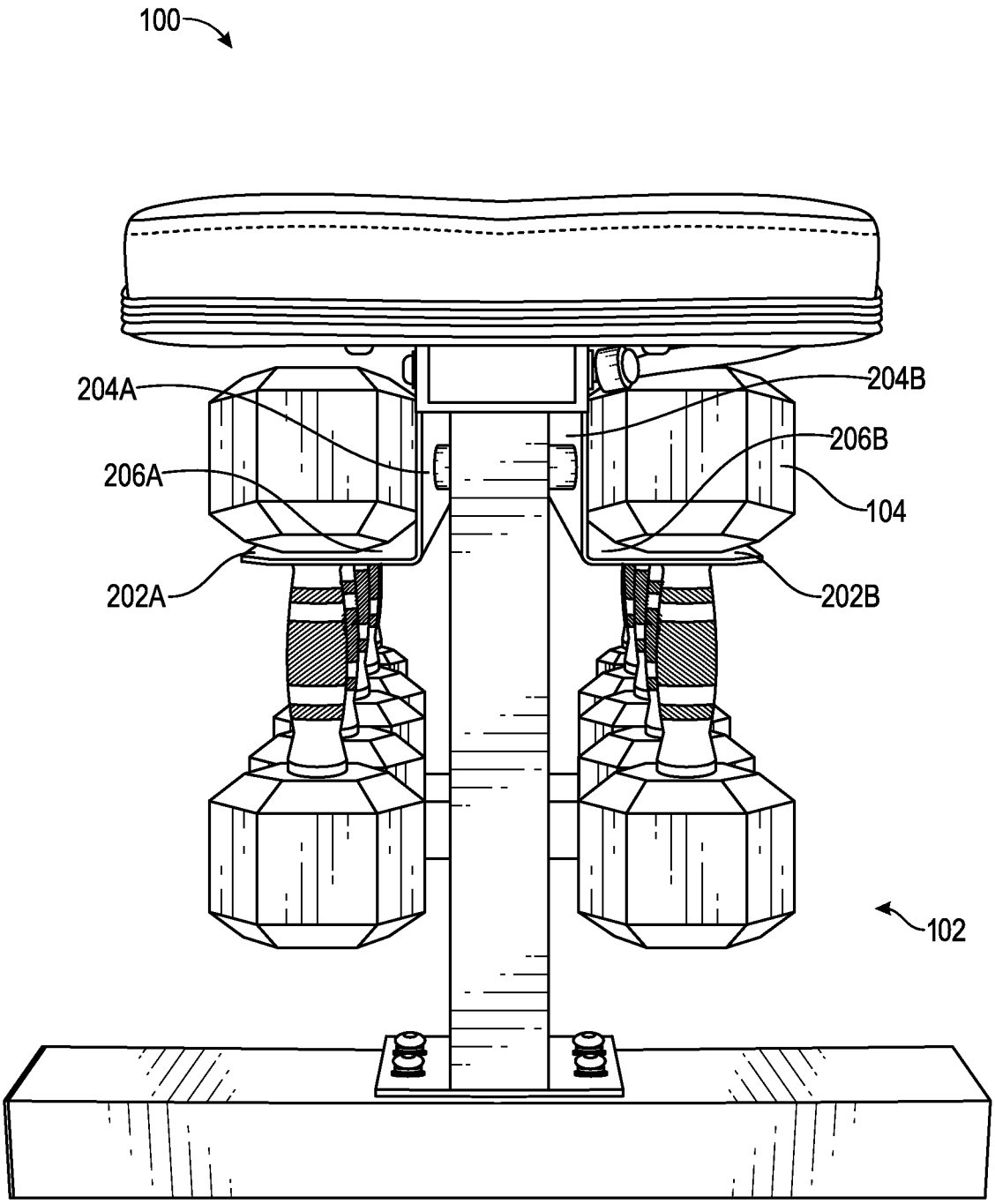

FIGS. 2 and 3 illustrate other exemplary views of the exercise apparatus 100 in accordance with one or more embodiments. As shown in FIG. 3, the weight storage unit 101 is configured to store the weights 104 in a vertical orientation. The weight storage unit 101 includes at least a first bracket member 202A, and preferably a pair of bracket members, that is, a first bracket member 202A and a second bracket member 202B (together "bracket member(s) 101") affixed to a first/left surface and a second/right surface of the bench frame 112 respectively. The presence of two bracket members 202A, 202B allows for additional weight storage and for weights to be distributed equally on each side of the workout bench 102. Additionally, as shown in FIG. 3, each of the two bracket members 202A, 202B have a mounting sidewall 204A, 204B and a storage sidewall 206A, 206B respectively.

In one embodiment, as shown in FIG. 2, a first bracket member 202A is a plate having a mounting sidewall 204 and a storage sidewall 206. The storage sidewall 206 extends perpendicularly from the mounting sidewall 204, such that the mounting sidewall is in a first plane and the storage sidewall 206 is in a second plane. The storage sidewall 206 extends outward and is substantially parallel to the floor where the exercise bench is placed. It is understood that the second bracket 202B member has a similar configuration which is not repeated herein for brevity. In another embodiment, the bracket member can include two separate plates that can be coupled along one of their edges such that a first plate is oriented perpendicular to the second plate.

The mounting sidewall 204 is secured to the side surface of the bench frame 102 using a fastener 120, such as, nuts and bolts, or other conventional fasteners. Alternately, the bracket members 101A, 101B can be welded to either side of the bench frame. Dumbbells of different or same weight ranges/sizes can be securely held within the bracket members 101A, 101B on either side of the bench frame 102.

The storage sidewall 206 is in a horizontal plane and is configured to be parallel to the base of the bench 102. The storage sidewall 206 includes a planar plate-like member 208 having a plurality of spaced apart apertures or slots 210*a*-210*e* (together "slot(s) 210") therein. Each slot 210 may be spaced equidistant from or at a predetermined distance (that may not be equidistant) from an adjacent slot(s). Each slot 210 is configured to receive a wide range of weights, such as, weights ranging from 5 lbs. to 25 lbs., or any other desired weight. Additionally, the slots 210 can be configured to receive weights having different types of weight heads, such as, round heads and hexagonal heads. The slots 210 can be substantially semi-circular/oval. Alternately, the slots 210 can be substantially square-shaped.

The slots 210 can be dimensioned to receive a portion of the handle 104A of the weight 104. A basal portion of a first weight head 104B of the dumbbell is securely held within the slot 210 and a first surface portion of the plate-like member 208. The weight 104 is held in a vertical orientation in the outwardly extending storage sidewall 206. The vertical orientation is ergonomic and facilitates a quick disengagement of weight from the slot. Furthermore, vertically hanging the weights 104 allow more weights to be properly stored and kept out of the way of the user. Additionally, the orientation of the weights 104 allow the user to easily select the necessary weight while still seated on the workout bench 102. This creates a more compact workout equipment area, better organization, and better usability around the workout bench for exercises.

In use, the user of the exercise bench can disengage one or, if needed, a pair of dumbbells 104 from the weight storage unit 101 to perform their exercises and then store those dumbbells back in the bracket members, all while still in a workout position on the bench 102. For instance, a user may reach below the bench 102, select a desired pair of weights 104 (for example, a pair of 25 lb. weights) from the bracket members 202A, 202B, and slide the weights 104 away from the slots 210 to remove them from the weight storage unit 101. Additionally, a pair of weights 104 may be replaced in the same manner, for example, the handle portions of the weights 104 can glide into the slots 210 on bracket members 202A, 2021B to be properly stored and supported therein. Moreover, the user can conveniently select another pair of dumbbells having a different weight to optimize their weight training regime without having to get up from the bench 102. The user can also perform exercises, as needed, with a single weight (instead of a pair of weights) by lifting the desired weight from the storage unit 101.

Figure 4A:
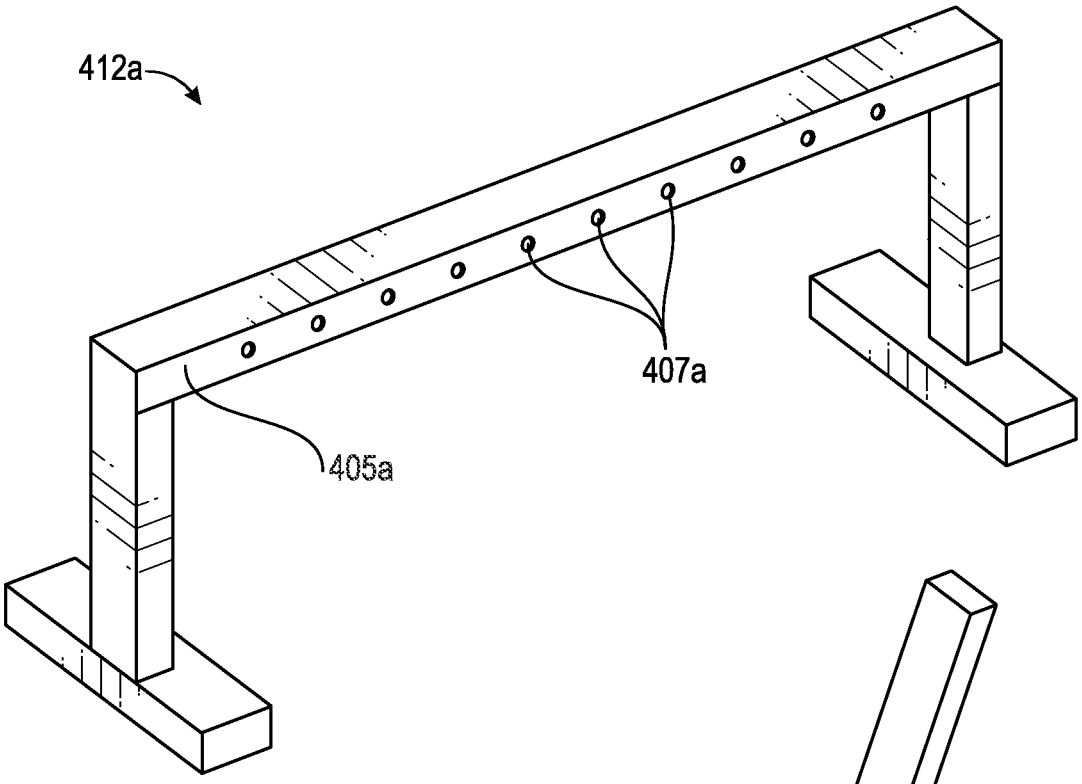
FIG. 4A illustrates a bench frame, according to an embodiment.
Figure 4B:
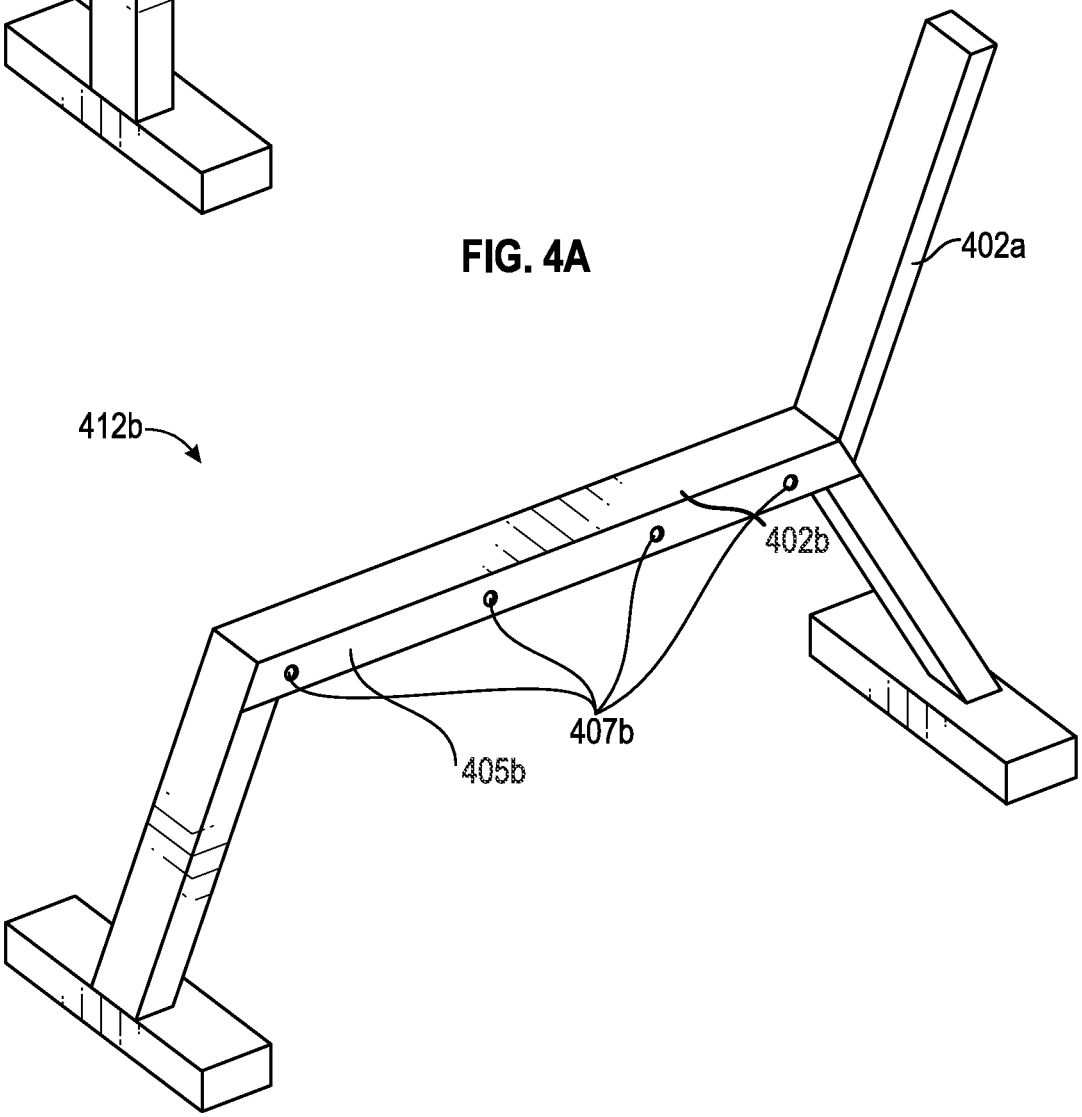
FIG. 4B illustrates a bench frame, according to another embodiment.

FIG. 4A-4B illustrate different embodiments of the bench frame 112.-FIG. 4A illustrates a bench frame 412*a* in accordance with an embodiment. As shown in FIG. 4A, at least one sidewall 405*a* of the bench frame 412*a* includes a plurality of pre-drilled mounting holes 407*a* for receiving a weight storage unit 401. It is understood that the sidewall opposite sidewall 405*a* can also include a plurality of mounting holes that correspond to mounting holes 407*a*. FIG. 4B illustrates yet another embodiment of the bench frame 412*b*. Bench frame 412*b* is configured to be inclined or declined. Bench frame 412*b* includes an angled head and back rest 402*a* and a seat 402*b*. Bench frame 412*b* is configured to be adjustable and/or foldable. The bench frame 412*b* also includes a plurality of mounting holes or opening 407*b* on at least a first sidewall 405*b*. However, it is understood that the sidewall opposite sidewall 405*b* can also include a plurality of mounting holes that correspond to mounting holes 407*b*.

Figure 4C:
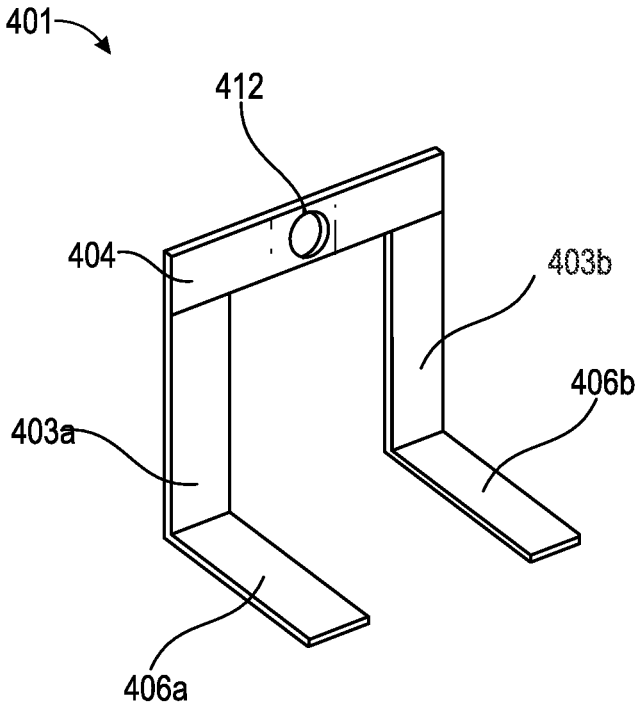
FIG. 4C illustrates a storage hook for use with the bench frames disclosed in FIGS. 4A-4B, according to an embodiment.

An exemplary weight storage unit is shown in FIG. 4C. The weight storage unit includes a mounting hook 401. The mounting hook 401 includes a fastener hole 412 on a mounting sidewall 404. The fastener hole 412 is sized to receive a mechanical fastener, such as, a screw or a bolt. In use, the mounting sidewall 404 can be positioned against sidewall 405*a*, 405*b* with the fastener hole 412 aligned with a mounting hole 407*a*, 407*b* of the bench frames 412*a*, 412*b*. The mounting hook 401 can then be secured to the bench frame 412*a*, 412*b* with a suitable mechanical fastener.

The mounting hook 401 includes a first sidewall 403*a* that extends from a first end of the mounting sidewall 404, and a second sidewall 403*b* that extends from a second end of the mounting sidewall 404. The sidewalls 403*a*, 403*b* terminate in weight storage members 406*a*, 406*b*. The pair of weight storage members 406*a*, 406*b* are oriented generally perpendicular to the corresponding sidewalls 403*a*, 403*b*. The weight storage members 406*a*, 406*b* are configured to support a weight (such as, dumbbell 104). As described earlier, the dumbbell can be securely held between the storage members 406*a*, 406*b* in a vertical orientation. It is understood that a plurality of mounting hooks 401 can be mounted on the bench frames 412*a*, 412*b* such that multiple weights can be stored on these hooks.

Figure 5A:
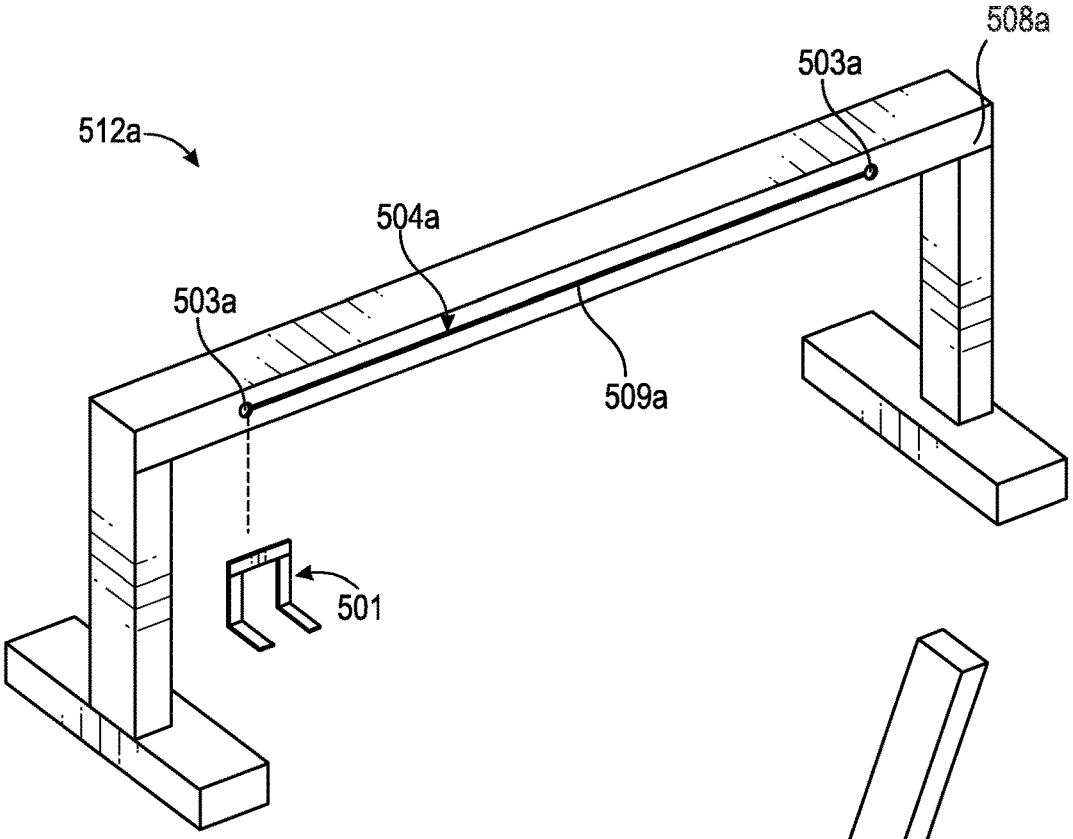
FIG. 5A illustrates a bench frame, according to an embodiment.
Figure 5B:
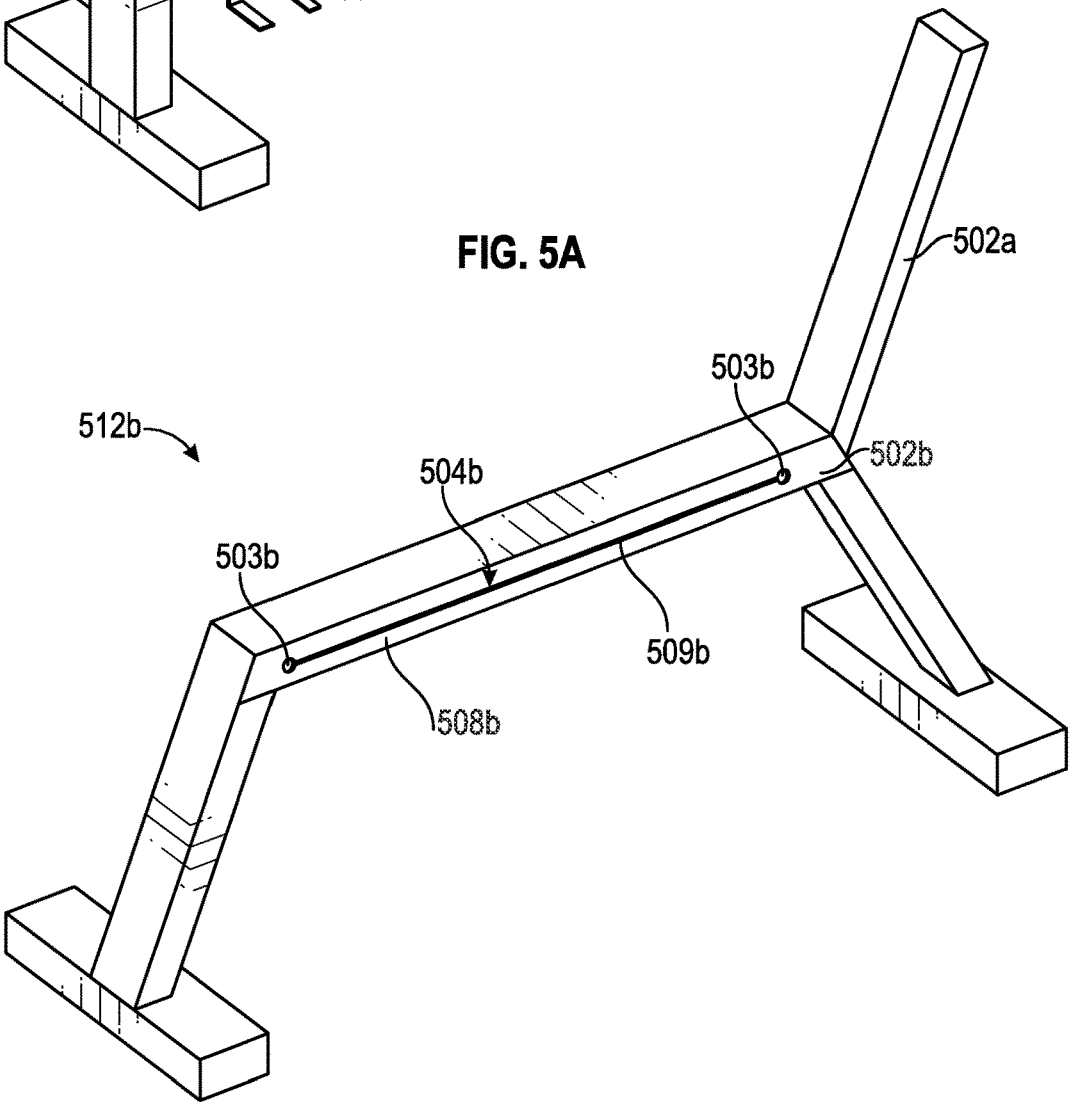
FIG. 5B illustrates a bench frame, according to another embodiment.

FIGS. 5A-5B illustrate additional embodiments of the bench frame 112. FIG. 5A illustrates a bench frame 512*a* in accordance with another embodiment. As shown in FIG. 5A, at least one sidewall 508*a* of the bench frame 512*a* is configured with a mounting channel 504*a* for receiving a weight storage unit 501. It is understood that the sidewall opposite sidewall 508*a* can also include a mounting channel that corresponds to mounting channel 504*a*. FIG. 5B illustrates yet another embodiment of the bench frame 512*b*. Bench frame 512*b* is configured to be inclined or declined. Bench frame 512*b* includes an angled head and back rest 502*a* and a seat 502*b*. Bench frame 512*b* is configured to be adjustable and/or foldable. The bench frame 512*b* includes a mounting channel 504*b* on at least a first sidewall 508*b*. It is understood that the sidewall opposite sidewall 508*b* can also include a mounting channel that corresponds to the mounting channel 504*b*. The mounting channels 504*a*, 504*b* include openings 503*a*, 503*b* and a central channel 509*a*, 509*b*. The openings 503*a*, 503*b* are configured as entry and exit points for the mounting hook 501.

Figure 5C:
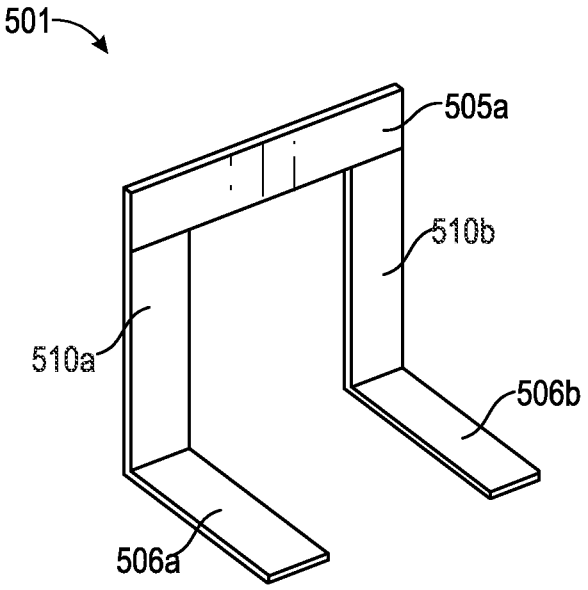
FIGS. 5C-5D illustrates a storage hook for use with the bench frames disclosed in FIGS. 5A-5B, according to an embodiment.
Figure 5D:
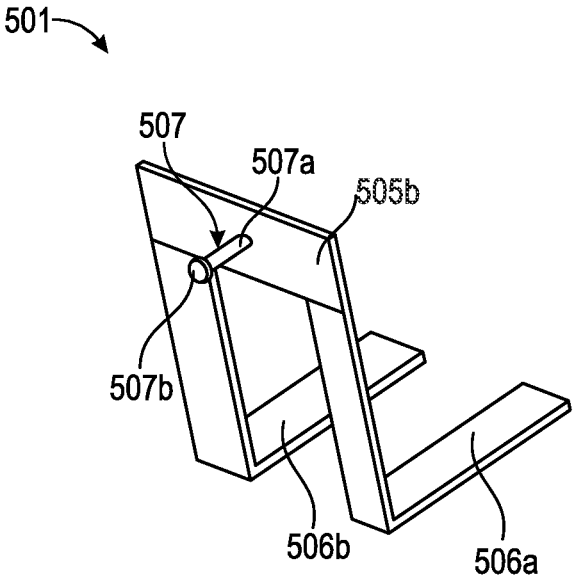

FIGS. 5C-5D illustrates an exemplary weight storage unit in accordance with yet another embodiment. The weight storage unit includes a mounting hook 501. The mounting hook 501 includes a first sidewall 510*a* that extends from a first end of the mounting sidewall 505*a*, and a second sidewall 510*b* that extends from a second end of the mounting sidewall 505*a*. The sidewalls 510*a*, 510*b* terminate in weight storage members 506*a*, 506*b*. The pair of weight storage members 506*a*, 506*b* are oriented generally perpendicular to the corresponding sidewalls 510*a*, 510*b*. The weight storage members 506*a*, 506*b* are configured to support a weight (such as, dumbbell 104). As described earlier, the dumbbell can be securely held between the storage members 506*a*, 506*b* in a vertical orientation. It is understood that a plurality of mounting hooks 501 can be mounted on the bench frames 512*a*, 512*b* such that multiple weights can be stored on these hooks.

The mounting hook 501 includes a securing fastener 507. The fastener 507 can be positioned on sidewall 505*b*. The fastener 507 has a protrusion 507*a* and a knob 507*b*. The knob 507*b* is sized to be snugly received within the mounting channel 504*a*, 504*b*. The fastener 507 is configured to slidably engage the openings 503*a*, 503*b*. Once the knob 507*b* has been inserted into the opening end 503*a*, 503*b*, the user may then slide the mounting hook 501 across the channel 504*a*, 504*b* to a desired position. As described earlier, the dumbbell can be securely held between the storage members 506*a*, 506*b* in a vertical orientation.

Figure 6A:
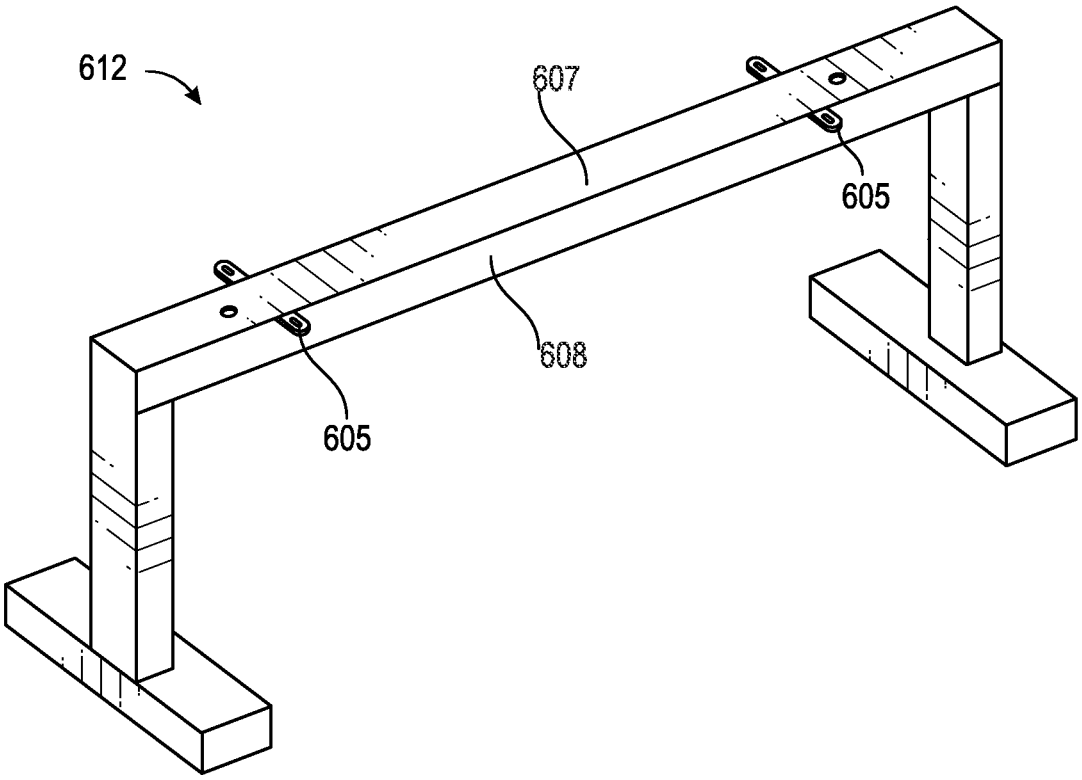
FIGS. 6A-6B illustrate exemplary views of a bench frame, according to an embodiment.
Figure 6B:
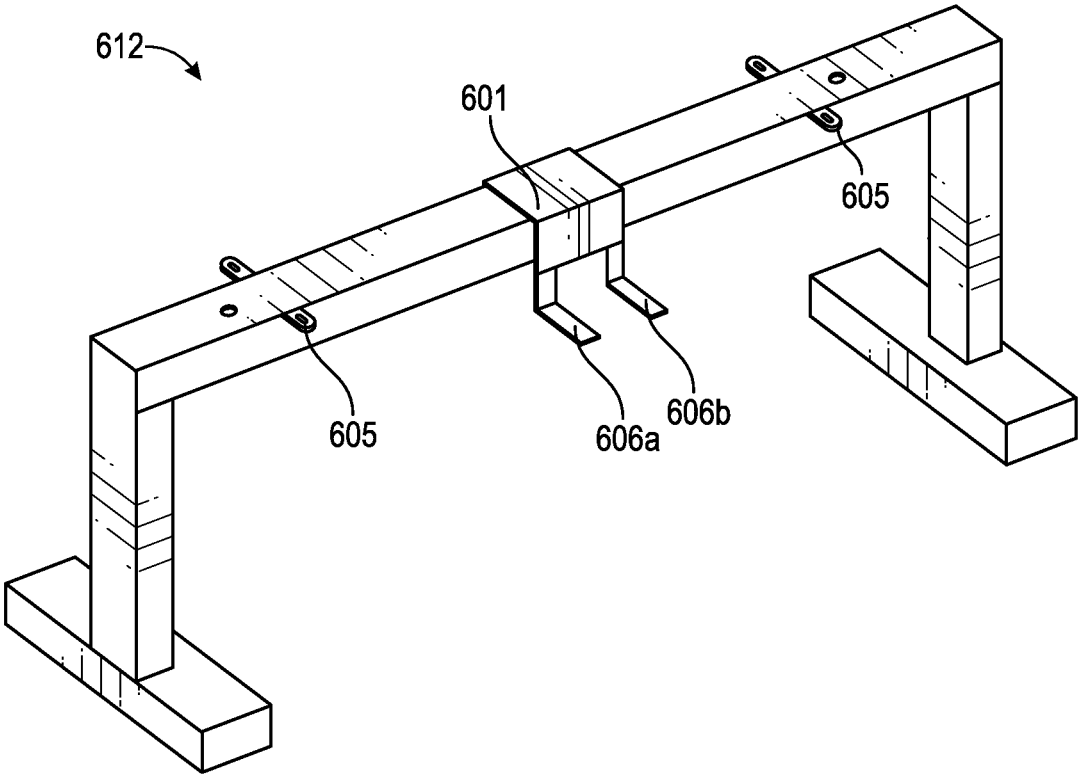

FIGS. 6A-6B illustrate another embodiment of the bench frame 112. As shown, the bench frame 612 has a pair of opposing bolt retention members 605. The bolt retention members are configured to receive bolts for attaching or removing a pad (such as, pad 103) off the bench frame 612. A weight storage unit 601 can be mounted over the bench frame 612.

Figure 6C:
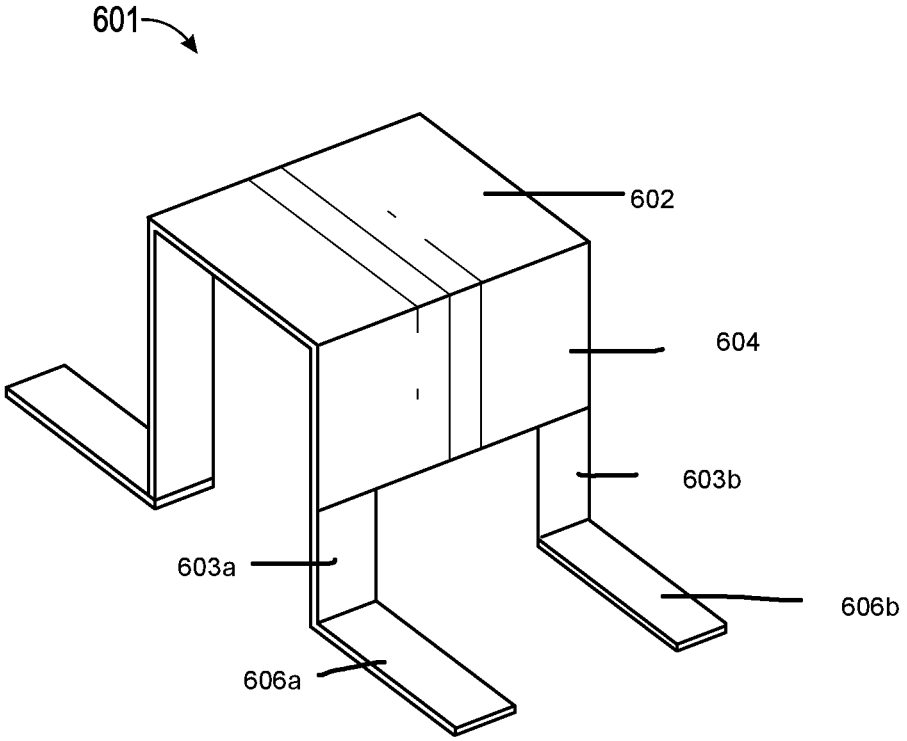
FIG. 6C illustrates a storage hook for use with the bench frame disclosed in FIGS. 6A-6B, according to an embodiment.

FIG. 6C illustrates a weight storage unit in accordance with an embodiment. As shown, the weight storage unit includes a mounting bracket 601. The mounting bracket 601 is substantially u-shaped and is configured to be mounted over the bench frame 612. The mounting bracket 601 includes a bracket top 602 connecting a pair of opposing mounting sidewalls 604. Sidewalls 603*a*, 603*b* extend from opposing ends of each of the mounting sidewalls 604. The sidewalls 603*a*, 603*b* terminate in weight storage members 606*a*, 606*b*. The pair of weight storage members 606*a*, 606*b* are oriented generally perpendicular to the corresponding sidewalls 603*a*, 603*b*. The weight storage members 606*a*, 606*b* are configured to support a weight (such as, dumbbell 104). As described earlier, the dumbbell can be securely held between the storage members 606*a*, 606*b* in a vertical orientation. It is understood that a plurality of mounting brackets 601 can be placed on the bench frame 612 such that multiple weights can be stored on these brackets. In use, the mounting sidewall 604 and bracket top 602 can be mounted over the bench frame 612, such that the bracket top 602 is against a top surface 607 of the frame 612 and mounting sidewalls 604 are against the bench frame sidewall 608. Once the mounting bracket 601 is mounted over the bench frame 612, a pad may be secured over the bench frame 612.

Figure 7A:
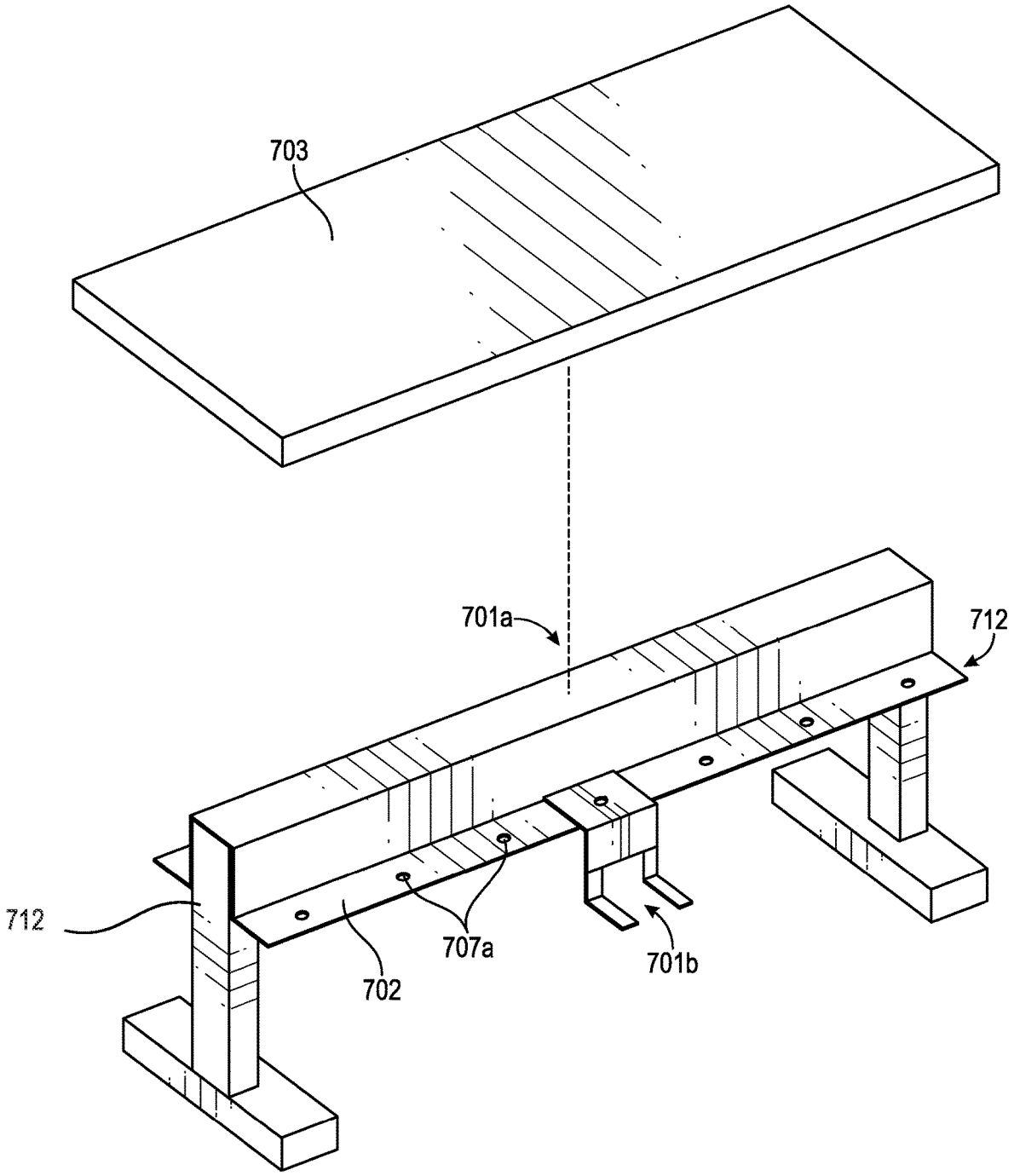
FIG. 7A illustrates a bench frame, according to an embodiment.
Figure 7B:
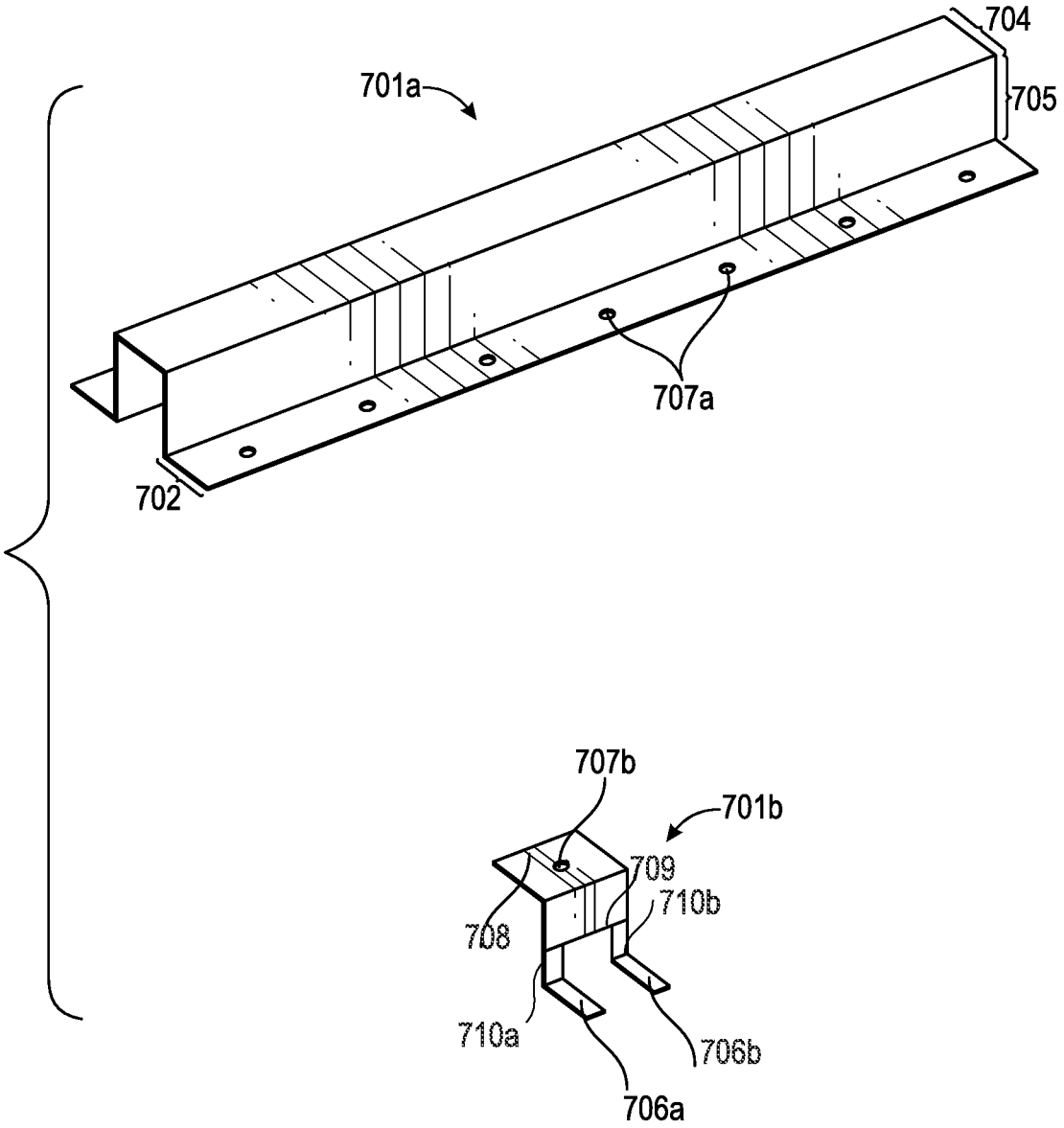
FIG. 7B illustrates a storage hook for use with the bench frame disclosed in FIG. 7A, according to an embodiment.

FIG. 7A illustrates another embodiment of the bench frame 112. As shown in FIG. 7A, bench frame 712 is configured to receive a weight storage unit. The weight storage unit includes an elongated rack 701*a* and a mounting/storage hook 701*b*. As shown in FIGS. 7A-7B, the rack 701*a* includes a top 704 and sidewall 705. At least one sidewall 702 of the rack 701*a* includes a plurality of predrilled mounting holes 707*a*. It is understood that the sidewall opposite sidewall 702 can also include a plurality of mounting holes that correspond to mounting holes 707*a*. A cushion 703 may be secured over the bench frame 712.

The storage hook 701*b* is configured to be coupled to the rack 701*a*. The storage hook 701*b* includes a mounting sidewall 708. A hole 707*b* for receiving a suitable mechanical fastener is located on the sidewall 708. The fastener hole 707*b* is sized to receive a suitable screw or a bolt. In use, the mounting sidewall 708 can be positioned against sidewall 702 of the rack 701*a* with the fastener hole 707*b* aligned with a mounting hole 707*a* of the rack 701*a*. The storage hook 701*b* can then be secured to the rack 701*a* with a suitable mechanical fastener. The storage hook 701*b* includes a first sidewall 710*a* that extends from a first end of the mounting sidewall 709, and a second sidewall 710*b* that extends from a second end of the mounting sidewall 709. The sidewalls 710*a*, 710*b* terminate in weight storage members 706*a*, 706*b*. The pair of weight storage members 706*a*, 706*b* are oriented generally perpendicular to the corresponding sidewalls 710*a*, 710*b*. The weight storage members 706*a*, 706*b* are configured to support a weight (such as, dumbbell 104). As described earlier, the dumbbell can be securely held between the storage members 706*a*, 706*b* in a vertical orientation. It is understood that a plurality of storage hooks 701*b* can be mounted on the bench frame 612 such that multiple weights can be stored on these hooks. Alternately, or in addition with being provided with the fastener holes for receiving the storage hooks, the sidewall 702 can also be configured with one or more slots as described in FIG. 2. As described in FIG. 2, each slot can be configured to receive a weight.

When using a conventional exercise bench and weight storage unit, a user may need to constantly get up from the exercise bench and walk to the weight storage unit to replace their weights or to get one or a pair of weights. This interrupts their training rhythm and causes them to lose valuable training time. By using the exercise bench with integrated or mounted weight storage unit of the present invention, the user can effectively use their training time without any such interruptions.

Some conventional exercise benches have weight storages that are laid out horizontally under the exercise bench. Alternately, some people choose to place the weights on the floor underneath the exercise bench. However, it is not desirable to store dumbbells under or underneath the bench in a horizontal plane because laying the weights in such an arrangement takes up a substantial amount of space resulting in fewer dumbbells being stored. Also, dumbbells stored horizontally under an exercise bench may get in the way of a user's foot or create a tripping hazard. The weights 104, in the present invention, can be conveniently and ergonomically arranged in a vertical orientation on the weight storage unit.

In one or more embodiments, the weight storage unit may be made of a suitable metal or PVC material to support the weight of the dumbbells 104.

While the weight storage unit is configured as a dumbbell storage unit, in one or more embodiments, the weight storage unit can also be used to hold other fitness products, workout shoes or other personal accessories. Alternately, the present invention can also be used as a workbench or a gardening seat with the ability to store hand tools and accessories in the weight storage unit beneath the bench frame. It can also be used in an entry room, utility room or hallway for storing pairs of shoes or other accessories, such as, dog leashes.

In another embodiment, an exercise apparatus kit contains a plurality of weight storage units, such as, mounting hooks and racks, as disclosed herein. The kit also contains instructions for securing or mounting the weight storage units onto the bench frame. The exercise apparatus kit can further optionally include one or more pairs of dumbbells.

The exercise apparatus, including the bench frames and weight storage units, of the present invention provides users with a cost-effective, convenient, and compact exercise solution for small rooms or space-constrained areas that cannot accommodate separate exercise benches and weight storage units. It can be used in home gyms, personal fitness training studios and commercial gyms. The present invention allows a user to optimize their weight training time by avoiding interruptions caused by getting up from the exercise bench to get weights of different ranges from a standalone weight storage unit.

While the foregoing describes various embodiments of the invention, other and further embodiments of the invention may be devised without departing from the basic scope thereof. The scope of the invention is determined by the claims that follow. The invention is not limited to the described embodiments, versions, or examples, which are included to enable a person having ordinary skill in the art to make and use the invention when combined with information and knowledge available to the person having ordinary skill in the art.

The invention claimed is:

1. An exercise apparatus, comprising:

an exercise bench, wherein the exercise bench comprises a bench frame; and a weight storage unit, wherein the weight storage unit includes:

a mounting bracket, the mounting bracket comprising:

a top wall, wherein the top wall is mounted over a top surface of the bench frame;

a first mounting sidewall extending from a first side of the top wall, wherein the first mounting sidewall further comprises a first pair of weight storage members; and a second mounting sidewall extending from a second side of the top wall, wherein the first and second mounting sidewalls project downward from opposite ends of the top wall, and wherein the second mounting sidewall further comprises a second pair of weight storage members, wherein each pair of weight storage members is configured to store a weight vertically in a slot therebetween.

2. The exercise apparatus according to claim 1, wherein each pair of weight storage members extends substantially perpendicular to their corresponding mounting sidewall.

3. The exercise apparatus according to claim 1, wherein the first and second mounting sidewalls are coupled to opposite sidewalls of the bench frame.

4. The exercise apparatus according to claim 1, wherein the weight is a dumbbell.

5. The exercise apparatus according to claim 1, further comprising a cushion or a pad.

6. The exercise apparatus according to claim 1, further comprising a pair of leg members, wherein a first end of each leg member is attached to a base of the bench frame.

7. The exercise apparatus according to claim 6, further comprising a pair of feet members, wherein a second end of each leg member is respectively attached to a top surface of one of the pair of feet members.

8. The exercise apparatus according to claim 5, further comprising a pair of opposing retention members, wherein each retention member is configured to receive one or more bolts for attaching and/or removing the cushion or pad to the top surface of the bench frame.

* * * * *